United States Patent [19]

Fu

[11] Patent Number: 4,996,633

[45] Date of Patent: Feb. 26, 1991

[54] ROTARY TYPE CLOCK ORNAMENT LAMP CIRCUIT STRUCTURE

[76] Inventor: Wang C. Fu, 3th, Floor, No. 10 Alley 7, Lane 185, Sec. 3, Shing Long Road, Taipei, Taiwan

[21] Appl. No.: 522,935

[22] Filed: May 14, 1990

[51] Int. Cl.[5] ..... F21V 21/30

[52] U.S. Cl. ..... 362/35; 362/272; 362/386

[58] Field of Search ..... 362/253, 35, 272, 386, 362/286

[56] References Cited

U.S. PATENT DOCUMENTS 4,734,830 3/1988 Cristian et al. ..... 362/35

*Primary Examiner*—Carroll B. Dority

*Attorney, Agent, or Firm*—Lowe, Price, LeBlanc, Becker & Shur

[57] ABSTRACT

A rotary type clock ornament lamp circuit structure, which comprises a turner having a transmission shaft to turn a positive pole distribution member and a negative pole distribution member to carry a plurality of sockets and lamp bulbs to rotate. By means of a ring-shaped positive pole and negative pole conductive members to respectively contact the positive pole distribution member and the transmission shaft of the turner, the positive and negative poles of the sockets are respectively connected with a power source to turn on the lamp bulbs during rotary motion.

3 Claims, 3 Drawing Sheets

ROTARY TYPE CLOCK ORNAMENT LAMP CIRCUIT STRUCTURE

BACKGROUND OF THE INVENTION

The present invention is related to clock ornament lamp circuit structures and more particularly to a rotary type clock ornament lamp circuit structure to carry a plurality of lamp bulbs to rotate while they are turned on to produce light.

The clock is a device used for measuring and indicating time. At the present time, accuracy and cost are not the only factors that a consumer would consider while buying a clock. Attrative design has now become an important factor a consumer would consider to buy a clock. Therefore, ornament lamp bulbs are commomly used to incorporate a clock for producing light effect. There is a kind of clock which is incorporated with an IC to control an ornament lamp thereon to intermittently produce light. There is also another kind of clock which utilizes a rotary color board to match with an ornament lamp to produce light effect. In regular clock ornament lamp circuit structure, ornament lamps are fixedly connected with a lamp circuit by means of welding connection. When an ornament lamp is burnt up, it is very difficult to fix a circuit and replace a new lamp.

SUMMARY OF THE INVENTION

One object of the present invention is to provide a rotary type clock ornament lamp circuit structure which can rotate while producing light.

Another object of the present invention is to provide a rotary type clock ornament lamp circuit structure which comprises a plurality of lamp bulbs respectively mounted on a plurality of sockets by means of plug-in connection for convenient replacement.

Still another object of the present invention is to provide a rotary type clock ornament lamp circuit structure which can match with a prism to produce variable light effect.

According to the present invention, a rotary type clock ornament lamp circuit structure is comprised of a turner, a conductive seat, a positive conductive member, a negative conductive member, a positive distribution member, a negative distribution member, an insulator, a plurality of sockets and a plurality of colorful lamp bulbs. By means of the operation of the turner, the lamp bulbs are carried to rotate while they are turned on to produce colorful light.

BRIEF DESCRIPTION OF THE DRAWINGS

The present invention will now be described by way of example with reference to the annexed drawings, in which.

DETAILED DESCRIPTION OF THE PREFERRED EMBODIMENTS

Figure 1:
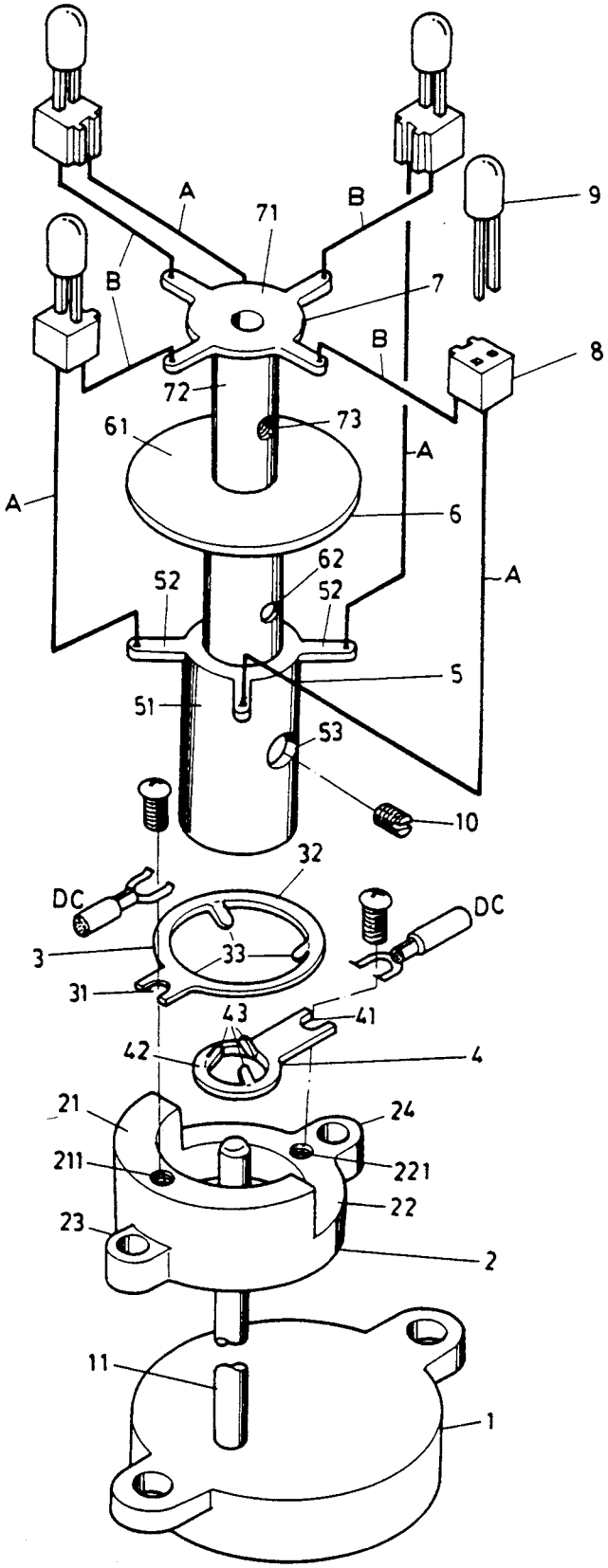
FIG. 1 is a perspective exploded view of the present invention.

Referring to FIG. 1, a rotary type clock ornament lamp circuit structure in accordance with the present invention is generally comprised of a turner 1, a conductive seat 2, a positive pole conductive member 3, a negative pole conductive member 4, a positive pole distribution member 5, an insulator 6, a negative pole distribution member 7, a plurality of sockets 8 and a plurality of lamp bulbs 9. The aforesaid component parts are vertically connected in series in proper order. The turner 1 is a forward-acting or forward-backward type of motorized or electro-magnetic device having a transmission shaft 11 thereon. The conductive seat 2 is a circular cylinder having a higher vertical wall portion 21, which comprises a bolt hole 211 on its topmost edge and as unitary lug 23 at its outer side, and a lower vertical wall portion 22, which comprises a bolt hole 221 on its topmost edge and a unitary lug 24 at its outer side. The positive pole conductive member 3 is substantially a copper ring 32 having a unitary U-shaped projection 31 transversely projecting outward and three projecting strips 33 transversely projecting inward. The negative pole conductive member 4 is substantially a copper ring 42 in size smaller than the copper ring 32 of the positive pole conductive member 3 and having an external projection 41 and three internal projecting strips 43. The positive pole distribution member 5 comprises a cylindrical body 51 having a cross-shaped distribution board 52 on its top and a through-hole 53 transversely through its periphery. The insulator 6 is comprised of a cylindrical post having an expanded insulating board 61 on its top and a through-hole 62 transversely through its periphery. The negative pole distribution member 7 comprises a cylindrical body 72 having a cross-shaped distribution board 71 on its top and a bolt hole 73 transversely through its periphery.

Figure 2A:
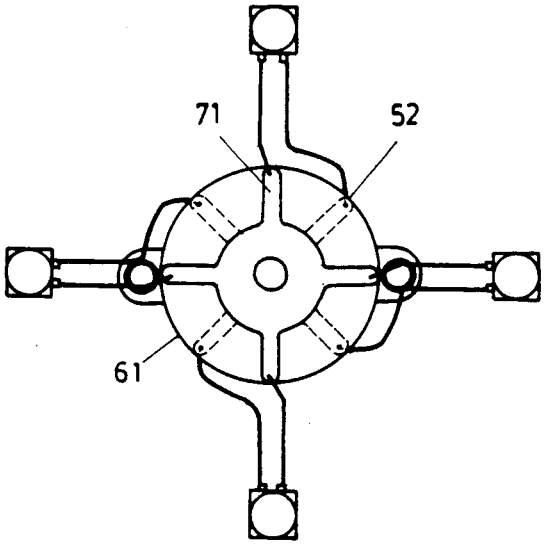
FIG. 2A is a top view of the device of this invention.
Figure 2B:
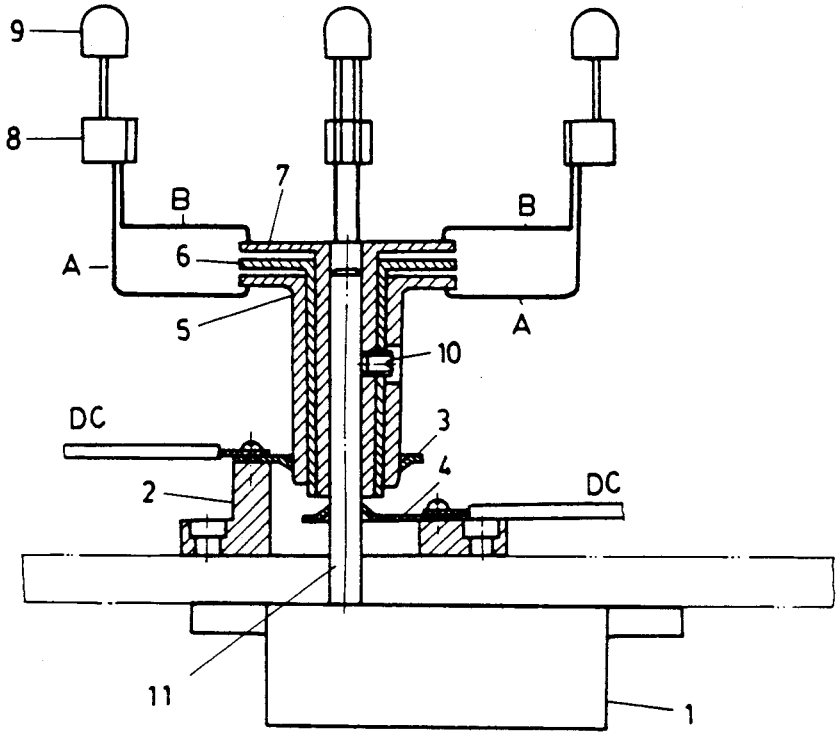
FIG. 2B is a side sectional view of the device of this invention.
Figure 3:
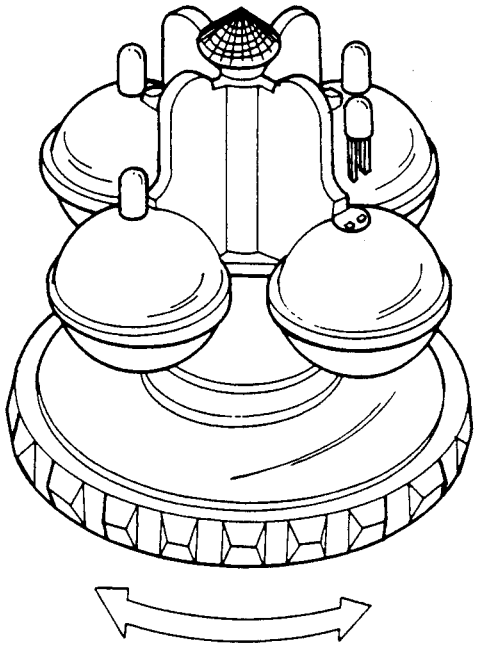
FIG. 3 illustrates a rotary type clock ornament lamp assembly embodying the present invention.

Referring to FIGS. 2A and 2B, the aforesaid component parts form a circuit to turn on the lamp bulbs 9. As illustrated, the positive pole conductive member 3 is mounted on the conductive seat 2 and connected to the positive poles of the sockets 8 by means of corresponding electric wires A on the four terminals of the cross-shaped distribution board 52 of the positive pole distribution member 5. The negative poles of the socket 8 are respectively connected to the negative pole distribution board 71 of the negative pole distribution member 7 via corresponding electric wires B and simultaneously connected with the transmission shaft 11 of the turner 1 through the cylindrical body 72 of the negative pole distribution member 7. The negative pole conductive member 4 is mounted on the transmission shaft 11 through which it is in connection with the negative poles of the socket 8. After the lamp bulbs 9 are respectively plugged in the sockets 8, a circuit is completely formed. Therefore, as soon as the positive pole conductive member 3 and the negative pole conductive member 4 are connected to a power source DC, the lamp bulbs 9 are immediately turned on to produce light. The positive pole distribution member 5 and the negative pole distribution member 7 are respectively mounted on the transmission shaft 11 by means of a lock bolt 10 and separated from each other by the insulator 6. During the operation of the turner 1, the positive pole and negative pole distribution members 5, 7 are driven by the transmission shaft 11 to carry the sockets 8 and the lamp bulbs 9 to rotate simultaneously. Because the positive pole and negative pole conductive members 3, 4 are respectively designed in a copper ring structure 32 or 42 having three projecting strips 33 or 43 therein to respectively contact the positive pole distribution member 5 and the transmission shaft 11, the contact of the positive pole conductive member 3 with the positive pole distribution member 5 and the contact of the negative pole conductive member 4 with the transmission shaft 11 are respectively constantly maintained while the positive pole distribution member 5 is carried by the transmission shaft 11 to rotate simultaneously.

What is claimed:

1. A rotary type clock ornament lamp circuit strcture, comprising:

a turner being a forward-acting or forward-backward type of motorized or electro-magnetic turning device, having a transmission shaft thereon;

a conductive seat being a circular cylinder having a higher vertical wall portion and a lower vertical wall portion, said higher vertical wall portion and said lower vertical wall portion having each a bolt hole on its topmost edge and an unitary lug at its outer side;

a positive pole conductive member being substantially a copper ring having an unitary U-shaped projection transversely projecting outward and three projecting strips transversely projecting inward;

a negative pole conductive member being substantially a copper ring in size smaller than the copper ring of said positive pole conductive member and having an external projection and three internal projecting strips;

a positive pole distribution member comprising a cylindrical body having a distribution board on its top and a through-hole transversely through its periphery;

an insulator comprised of a cylindrical post having an expanded insulating board on its top and a through-hole transversely through its periphery;

a negative pole distribution member comprising a cylindrical body having a distribution board on its top and a bolt hole transversely through its periphery;

a plurality of sockets; and a plurality of lamp bulbs being respectively mounted on said sockets by means of plug-in connection.

2. A rotary type clock ornament lamp circuit structure as claimed in claim 1, including three projecting strips on said positive pole conductive member and three projecting strips on said negative pole conductive member are respectively pressing on said positive pole distribution member and said transmission shaft to form a circuit permitting said transmission shaft to rotate therein.

3. A rotary type clock ornament lamp circuit structure as claimed in claim 1, wherein said positive pole distribution member and said negative pole distribution member comprise each a cylindrical body having a distribution board thereon, said distribution board being shape designed to provide a plurality of terminals according to the quantity of said lamp bulbs and said sockets.

* * * * *